US008302815B2

(12) United States Patent
Gashi

(10) Patent No.: US 8,302,815 B2
(45) Date of Patent: Nov. 6, 2012

(54) DEVICE FOR COMPLETE EMPTYING OF A TUBE

(76) Inventor: Bahtir Gashi, Bruchkobel (DE)

( * ) Notice: Subject to any disclaimer, the term of this patent is extended or adjusted under 35 U.S.C. 154(b) by 324 days.

(21) Appl. No.: 12/796,051

(22) Filed: Jun. 8, 2010

(65) Prior Publication Data

US 2010/0314409 A1 Dec. 16, 2010

(30) Foreign Application Priority Data

Jun. 10, 2009 (DE) ..... 20 2009 004 909 U

(51) Int. Cl.
*B65D 35/34* (2006.01)

(52) U.S. Cl. ..... 222/100; 222/213

(58) Field of Classification Search ..... 222/95, 222/97–99, 100–106, 214
See application file for complete search history.

(56) References Cited

U.S. PATENT DOCUMENTS 1,543,518 A * 6/1925 Ramsey ..... 222/97
1,939,575 A * 12/1933 Smith ..... 222/97
1,973,543 A * 9/1934 Simon ..... 222/98
2,747,772 A * 5/1956 Ernst ..... 222/100
3,473,698 A * 10/1969 Ballin ..... 222/100
3,628,696 A * 12/1971 Duiker ..... 222/99
3,885,708 A * 5/1975 Parry ..... 222/100
3,910,460 A * 10/1975 Hausmann et al. ..... 222/99
5,421,486 A * 6/1995 Simmons ..... 222/100
5,480,065 A * 1/1996 Powers ..... 222/99
5,642,839 A * 7/1997 Lee ..... 222/99
6,568,564 B2 * 5/2003 Wheatley ..... 222/100

FOREIGN PATENT DOCUMENTS

DE 2412469 9/1975
DE 29717321 1/1998
DE 20310094 10/2003

* cited by examiner

*Primary Examiner* — Lien Ngo
(74) *Attorney, Agent, or Firm* — Dennison, Schultz & MacDonald

(57) ABSTRACT

A device for the complete emptying of a tube including a tube body with a tube head and a tube opening located in the head, with the device including a base body with a slot-shaped tube receptacle as well as a shaft rotatable in the base body with a holder for the crimped end of a tube, the shaft being rotatable in the base body to roll up the tube body on the shaft and the tube contents being expressible by pulling the tube body through the slot-shaped tube receptacle. In order to be able to empty any residue contained in the tube head, the design provides for a lever to be articulated on the base body, with which the tube head can be pressed against the base body for a complete emptying of the tube.

17 Claims, 6 Drawing Sheets

DEVICE FOR COMPLETE EMPTYING OF A TUBE

BACKGROUND OF THE INVENTION

The invention relates to a device for the complete emptying of a tube comprising a tube body with a tube head and a tube opening located in the latter, with the device comprising a base body with a slot-shaped tube receptacle as well as a shaft rotatable in the base body having a retaining fixture for the crimped end of a tube and the shaft being rotatable in the base body to roll up the tube body on the shaft and the tube contents being expressible by pulling the tube body through the slot-shaped tube receptacle.

A device for the emptying of tubes of the type mentioned at the beginning is described, for example, in DE 297 17 321 U1. The known device is supposed to make it possible to completely squeeze synthetic tubes empty. To this end, for the purpose of emptying, synthetic tubes are rolled up in infinitely variable and space-saving fashion on a slotted shaft with a wheel mounted in a pipe.

During the emptying process, particularly of metal tubes having a tube head following a truncated cone surface and a subsequent cylinder-shaped tube opening, there arises the problem that a complete emptying can not be done by means of the known device since residues of the tube contents will remain in the tube head because it can not be pulled through the slot-shaped tube receptacle. In the case of valuable tube contents such as, for example, hair dying agents, ointments or crèmes, a complete emptying may lead to considerable cost savings.

DE 203 10 094 U1 describes a squeezing device to squeeze out tubes made of a synthetic material with a tube head equipped with an outlet nozzle and a tube hose attached thereto. The squeezing device consists of a clamping piece with a transversal slot that compresses the tube hose and is characterized in that the clamping piece has a pressure form contoured to the tube head in form-fitting fashion and that it can be attached to the tube head on the side of the hose.

SUMMARY OF THE INVENTION

Based on the above, it is an object of the invention to further develop a device for the complete emptying of tubes in such a way that the residues remaining in the tube head can be completely squeezed out as well.

This object is attained in accordance with the invention, among other things through the fact that a lever is articulated on the base body in which the tube head can be pressed against the base body for a complete emptying of the former.

In contrast with the state of the art, this leads to the advantage that the residues remaining in the tube head can be completely squeezed out as well since great forces can be exerted by means of the lever in order to press the tube head against the exterior surface of the base body with the result that the residues located in the tube head which preferably has a truncated cone shape can be completely emptied out.

A preferred embodiment provides that the tube receptacle formed into the base body preferably have a spherical or cone-shaped curvature that interacts with a preferably spherical or cone-shaped indentation formed into the lever, with the indentation having an aperture to accommodate the tube opening. The curvature formed in the area of the tube receptacle achieves a better alignment with the tube head which, as a rule, has a truncated cone shape, so that any expenditure of energy required for a complete emptying of the tube head area of a tube will be kept at a minimum.

Preferably, the base body has a drum-shaped segment into which the slot-shaped tube receptacle is inserted. The bow-shaped lever is preferably articulated to an exterior side of the drum-shaped segment and abuts in its closed state the surface of the drum, preferably in form-fitting fashion.

In order to simplify the manipulation of the lever, it preferably has a T-shaped handle area that extends in longitudinal direction of the base body and that can be activated for example by the thumb of a user's hand.

The shaft is preferably mounted rotatably in the drum-shaped base body, with the shaft having on one side a rotating wheel that abuts the frontal opening of the drum-shaped base body.

Preferably, the drum-shaped base body is equipped opposite the open frontal side with a handle corresponding to the rotating wheel of the shaft. The shaft may taper in the direction of its free end in order to facilitate a sliding off of the rolled up tube body.

BRIEF DESCRIPTION OF THE DRAWINGS

Additional details, advantages and characteristics of the invention result not only from the claims, from the characteristics to be found in the latter—per se and/or in combination—but also from the following description of an embodiment to be found in the drawings, in which:

DESCRIPTION OF THE PREFERRED EMBODIMENTS

Figure 1:
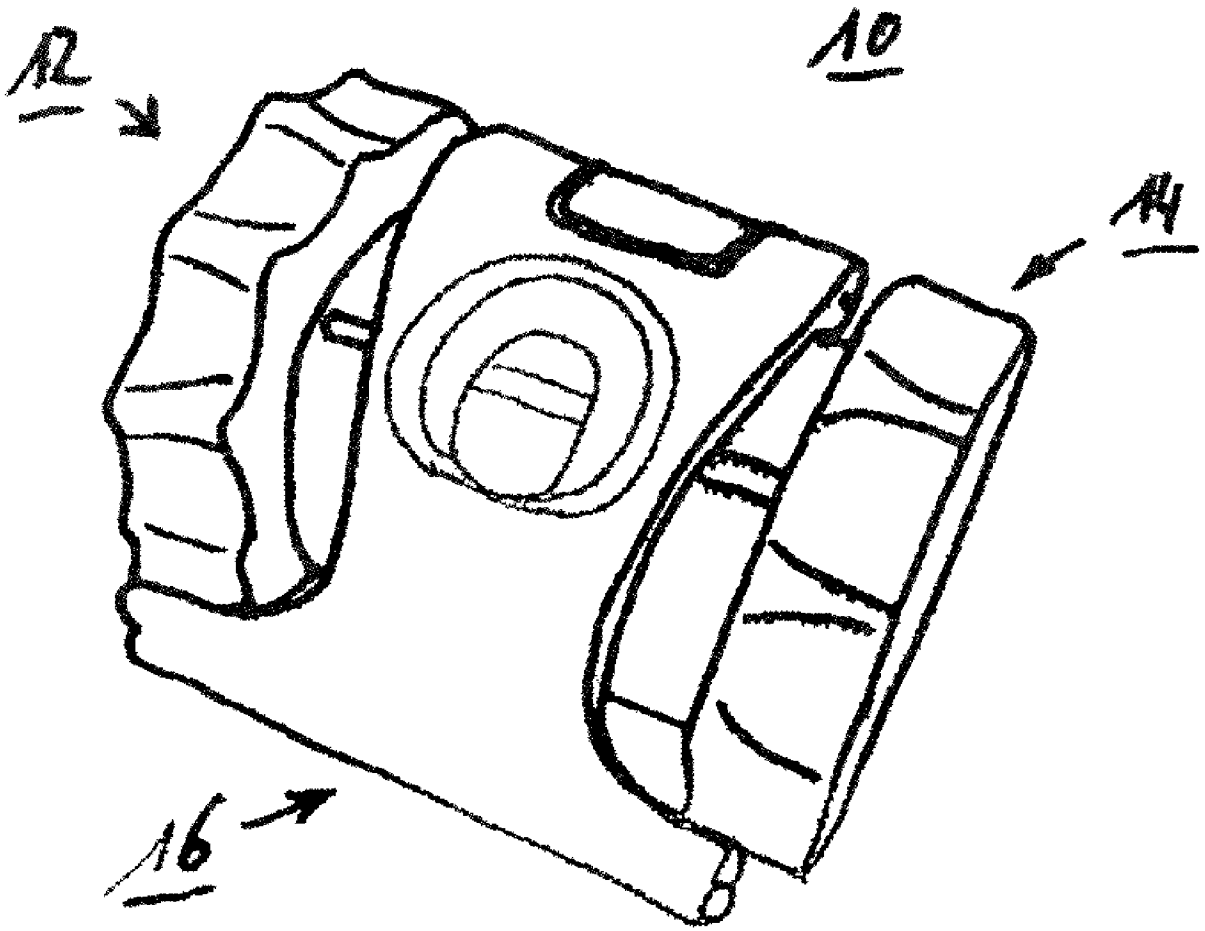
FIG. 1 is a perspective representation of a tube being squeezed for the complete emptying of the tube.

FIG. 1 shows a tube squeezer 10 in a perspective representation that essentially comprises a base body 12, a rotating element 14 as well as a lever 16 that is connected with the base body in articulated fashion.

Figure 2:
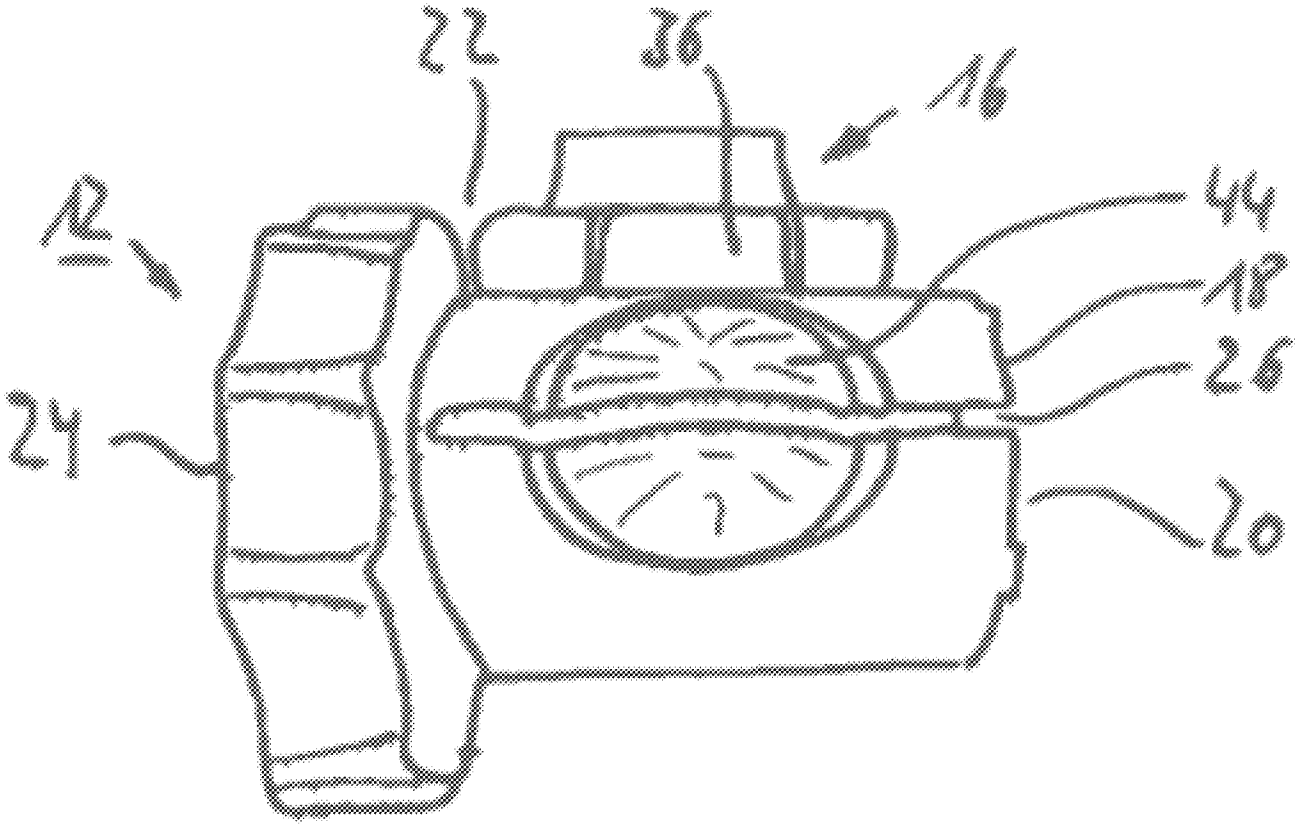
FIG. 2 is a perspective representation of a base body of the tube squeezer with an articulated emptying lever.
Figure 3:
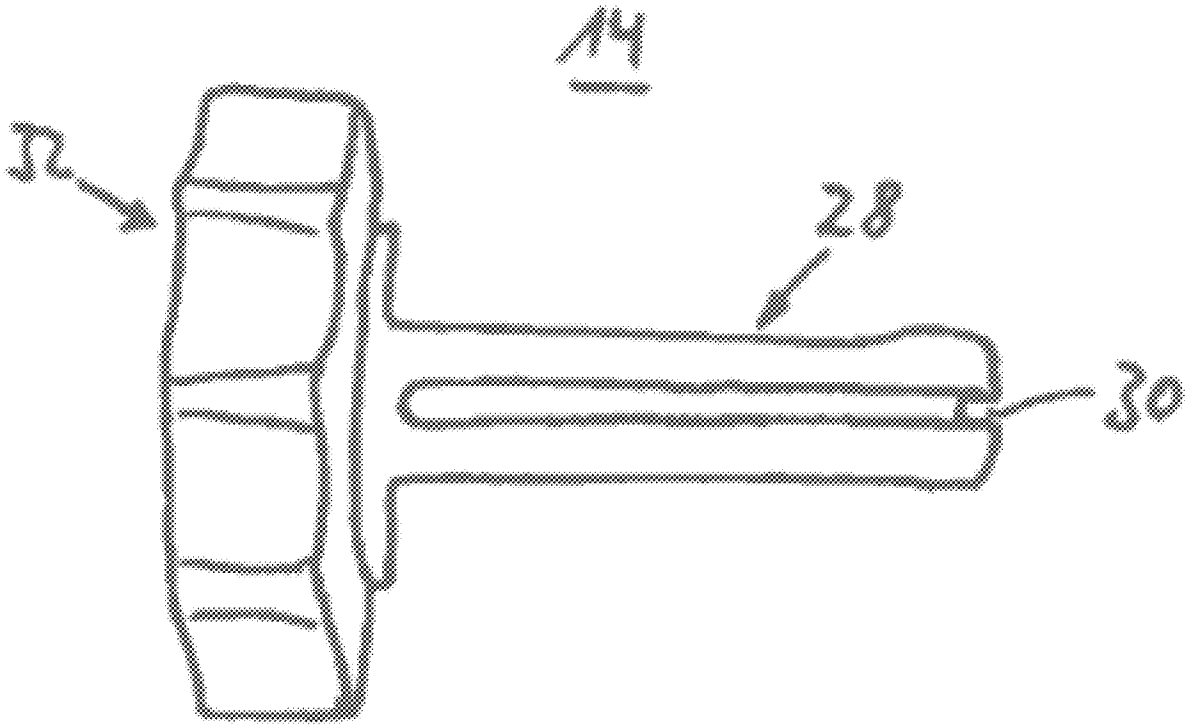
FIG. 3 is a bottom view of the emptying lever.

The base body 12 together with the pressure lever 16 is shown in FIG. 2. The base body 12 comprises a drum-shaped segment 18 that is open on a first frontal side 20 and equipped with a handle 24 on an opposite frontal side 22. A slot-shaped tube receptacle 26 extending from the frontal side opening 20 to the handle 24 is inserted into the drum-shaped segment 18 in longitudinal direction, parallel to the rotational axis.

The rotating element 14 having a shaft 28 with at least one slot 30 to accommodate the crimped end of a tube is mounted in the drum-shaped segment 18 of the base body 12. The shaft is equipped with a rotating wheel 32 that corresponds approximately to the handle 24 of the base body 12 in its form and shape.

Figure 4:
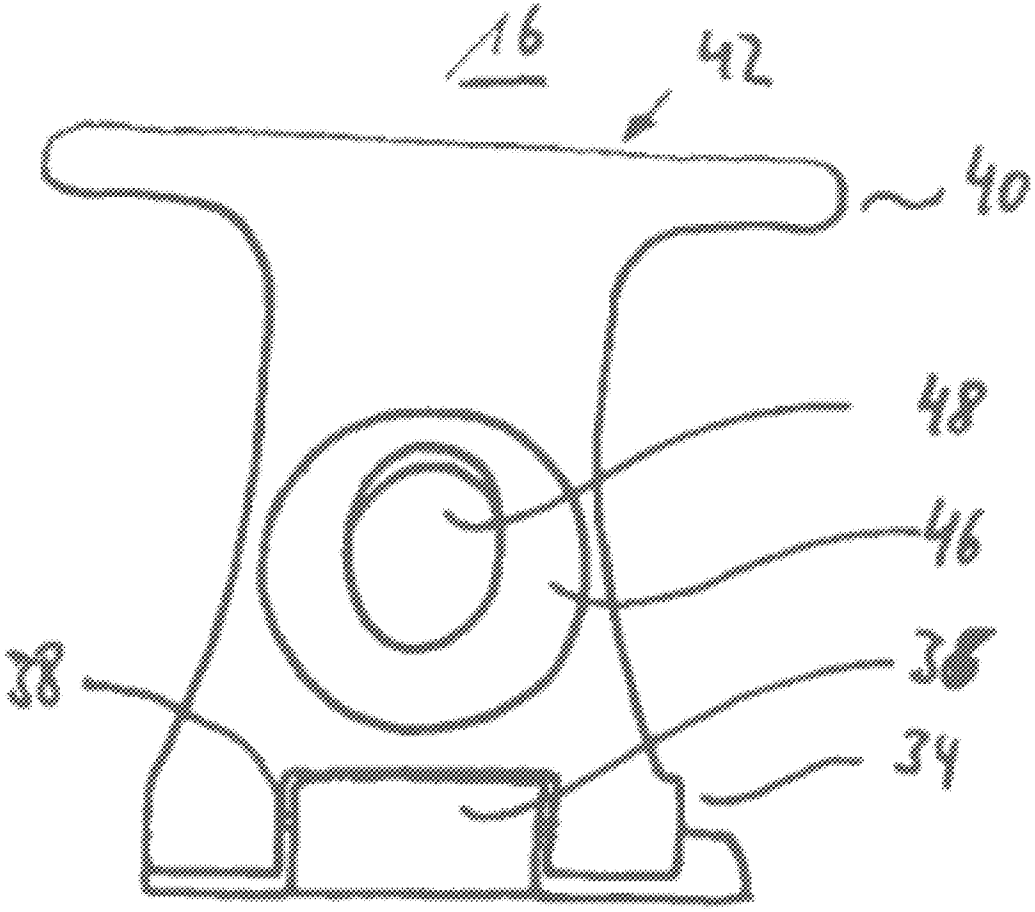
FIG. 4 is a shaft rotatable in the base body, with a rotating wheel.

The lever 16 is shown in FIG. 4. With one first end 34, the lever 16 is connected in articulated fashion with the base body 12. To this end, a bearing 36 is formed onto the surface of the drum-shaped segment 18; the end 34 is arranged on the bearing in articulated fashion by means of a pin 38 in the manner of a hinge. On a second end 40 of the lever, an essentially T-shaped handle 42 is arranged to actuate the lever, for example by means of the thumb of either hand of the user. The T-shaped handle 42 has a length that essentially corresponds to the longitudinal extension of the base body plus the side of the rotating wheel 32.

In FIG. 1, it can be seen that the lever 16 is designed in a bow shape and that it is essentially contoured to the cylinder-shaped surface of the drum-shaped segment 18. In the closed state of the lever, the T-shaped handle 42 extends outward essentially in radial direction.

Figure 5:
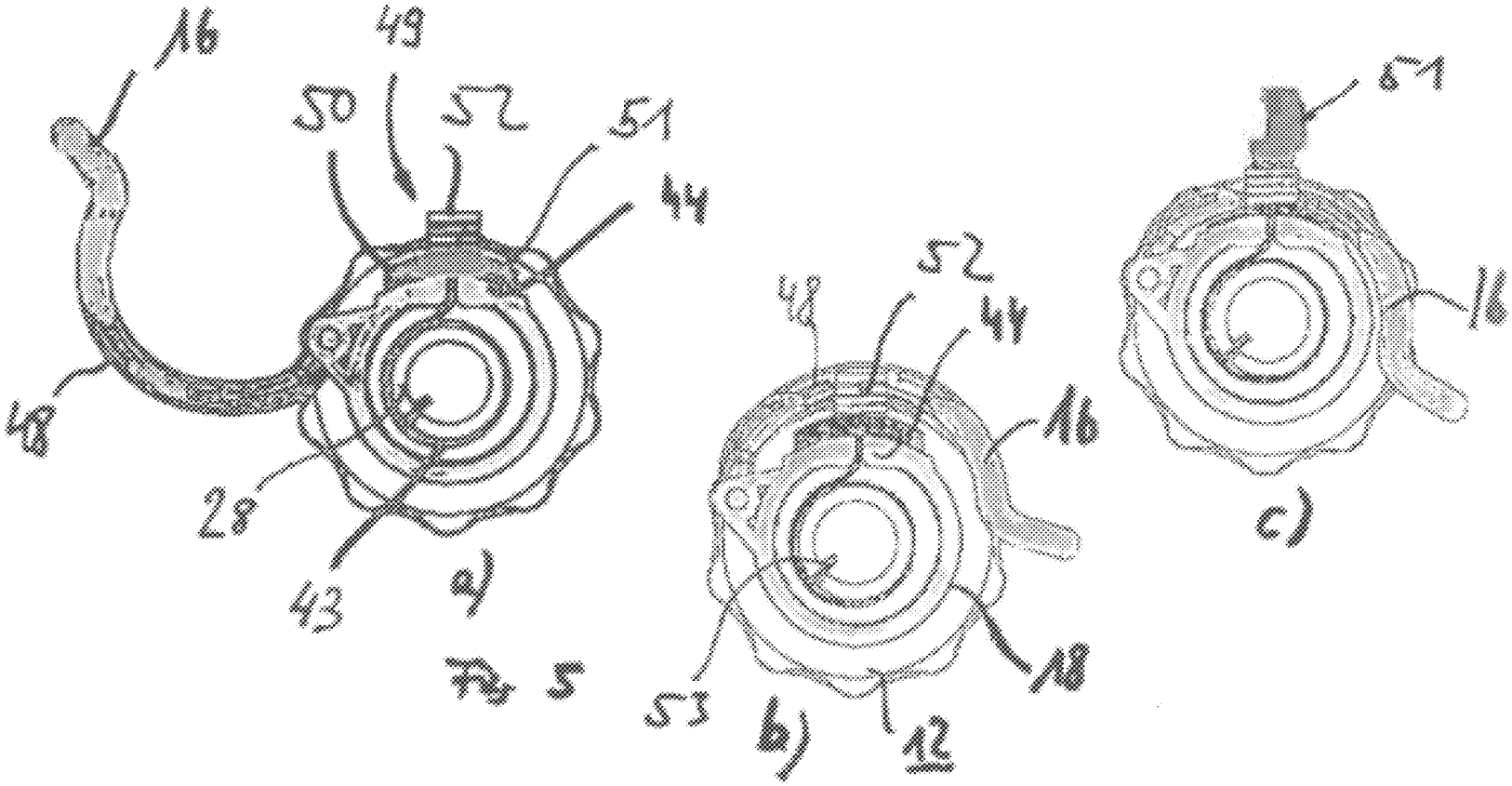
FIGS. 5 *a*) through *c*) show a cross sectional representation of the tube squeezer, with the pressure lever being shown in various positions.

Individual phases of the use of the tube squeezer are represented in Figures a) through e). FIG. 5 *a*) shows the tube squeezer 10 in a position in which the tube body 43 of a tube 49 is already completely wound up on the shaft 28, however with one tube head 50 not having been completely emptied. Further emptying by turning the shaft 28 is no longer possible. By applying the lever 16 and pressing it against the base body 12, the tube head 50 is pressed against the curvature 44 so that any residue 51 contained in the tube head 50 will be completely squeezed out, a condition shown in FIG. 5 *c*).

For a complete emptying in particular of the tube head 50 which commonly follows a surface of a truncated cone segment, a curvature 44 extending outward is provided in the area of the slot-shaped tube receptacle of the drum-shaped segment 18. Correspondingly, an indentation 46 interacting with the curvature 44 is arranged in the lever 16. Moreover, the indentation 46 is provided with a through hole 48 to accommodate a tube opening 52.

To use the tube squeezer, the crimped end of a tube 53 of a preferably half-emptied tube 49 is inserted into the slot-shaped receptacle 30 of the shaft 28 and then pushed into the slot-shaped tube receptacle 26 together with the already emptied section of the tube 49. By turning the rotating wheel 32, the tube body is wound up on the shaft 28, with the tube body being pulled through the slot-shaped tube receptacle 26 and the tube contents being squeezed out through the tube opening. If the tube head abuts the spherical or cylindrical curvature 44, the lever can be used in accordance with the invention for a complete emptying, with the lever pressing the tube head against the curvature 44 in order to empty the tube head completely.

The tube squeezer may be used by an operator in such a way that the base body 12 is held tightly in one hand by way of the handle element 24 and a rolling up and thereby an emptying of the tube contents occurs by means of the other hand using the rotating wheel. Operating the lever 16 will then also be done with the use of both hands, with the T-shaped handle assuring a complete emptying of the tube head by exerting force with the thumbs of the right and left hands.

Figure 6:
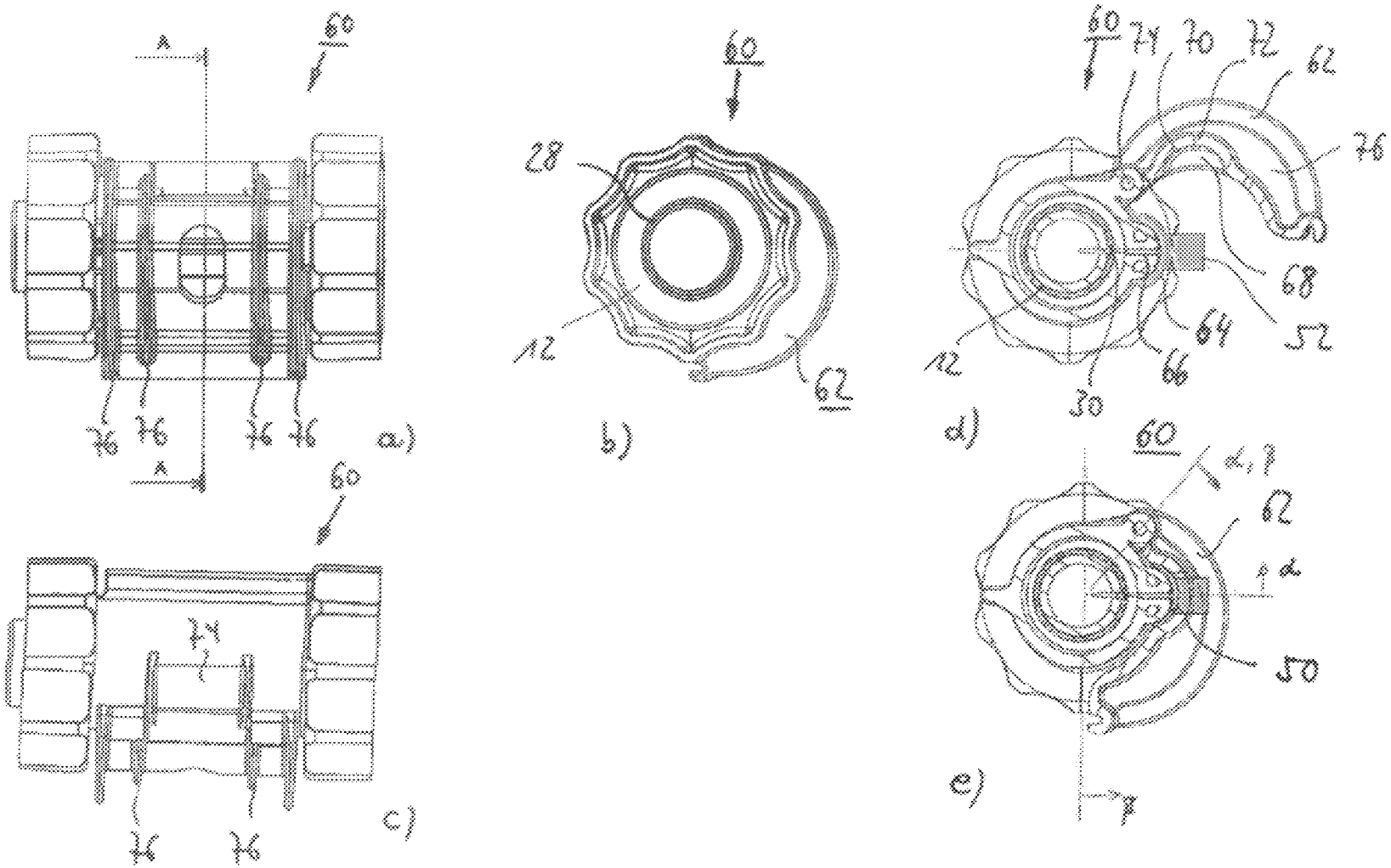
FIGS. 6 *a*) through *e*) show a top view, a lateral view as well as a bottom view of an alternative embodiment of a tube squeezer as well as a cross sectional representation with an open pressure lever and a cross sectional representation with a closed pressure lever.

FIGS. 6 *a*) through *e*) show an alternative embodiment of a tube squeezer 60 that essentially has the same structure as tube squeezer 10 in accordance with FIGS. 1 through 5.

In FIGS. 6 *d*) and *e*), the tube squeezer 60 is shown on the one hand in a cross section with an open lever 62, and in FIG. 6 *e*) with a closed lever 62.

The embodiment in accordance with FIG. 6 differs from that shown in FIGS. 1 through 5 in that the spherical or, respectively, cone-shaped curvature 44 and the corresponding shape 46 of the lever 16 have been replaced by a curvature 64 extending along a longitudinal axis of the axis and essentially following the surface of a semi-cylinder. A slot-shaped tube receptacle 66 divides the curvature 64 into two segments. Correspondingly, the pressure-activated lever 62 has a form 68 whose interior side 70 essentially follows the surface of a cylinder.

Of course, an opening 72 is provided within the molding 68 to guide the tube head 52 through.

Moreover, it is provided that an articulation point 74 for the lever 62 is arranged at an angle $\alpha$ of $30 \leqq \alpha \leqq 70°$, preferably $45\alpha \leqq 55°$ relative to the slot-shaped tube receptacle. A lever ratio of ⅓ to ⅔ is achieved by means of the lever 62, with the length between the articulation point 74 and the molding 68 corresponding to approximately ⅓ of the overall length of the lever 62.

FIG. 6 *e*) shows the tube squeezer 60 in a state in which the lever 62 is closed and the contents of the tube 50 has been completely squeezed out, running in circumferential direction of the lever 62.

Preferably, an angle $\alpha$ between the articulation point 74 and the tube receptacle 66 comprises an angle $\alpha$ within the range of $0° \leqq \alpha \leqq 90°$, preferably $45° \alpha \leqq 55°$. The lever 62 may have a circumferential extension $\beta$ in circumferential direction within the range of $110° \leqq \beta \leqq 180°$, preferably $\beta = 145°$.

What is claimed is:

1. Device (10, 60) for the complete emptying of a tube (49) comprising a tube body (43) with a tube head (50) and a tube opening (52) located in the tube head, the device comprising a base body (12) with a slot-shaped tube receptacle (26, 66) as well as a shaft (28) rotatable in the base body with a holder for the crimped end of a tube (30) and the shaft being rotatable in the base body (12) to roll up the tube body (43) on the shaft and the tube contents being expressible by pulling the tube body (43) through the slot-shaped tube receptacle (26, 66), wherein a lever (16, 62) is articulated on the base body (12) through which the tube head (50) can be pressed against the base body (12) for a complete emptying of the tube.

2. Device according to claim 1, wherein the tube receptacle (26, 66) formed into the base body (12) has a curvature (44, 64) that interacts with an indentation (46, 68) formed into the lever (16, 62), with the indentation (46, 68) having a through hole (48, 72) to accommodate the tube opening (52).

3. Device according to claim 2, wherein the curvature (44, 64) has a spherical and/or cylindrical shape.

4. Device according to claim 2, wherein the indentation (46, 68) has a spherical, conical and/or cylindrical shape.

5. Device according to claim 2, wherein the base body (12) has a drum-shaped segment (18) into which the slot-shaped tube receptacle (26, 66) is installed in axial longitudinal direction.

6. Device according to claim 5, wherein the lever (16, 66) is articulated on a surface of the drum-shaped segment (18) and curved in such a way that in its activated state it abuts the surface of the drum-shaped segment (18) in form-fitting fashion.

7. Device according to claim 1, wherein the lever (16) has a handle area (42) extending in longitudinal direction of the base body.

8. Device according to claim 7, wherein the handle area (42) is T-shaped.

9. Device according to claim 1, wherein the shaft (28) is rotatably mounted in the drum-shaped segment of the base body (12).

10. Device according to claim 1, wherein the shaft (28) has a rotating wheel (32) at one end thereof that abuts the frontal opening of the drum-shaped segment (18).

11. Device according to claim 1, wherein the shaft (28) tapers in the direction of its free end.

12. Device according to claim 5, wherein the drum-shaped segment (18) has a handle (24) opposite the open frontal side.

13. Device according to claim 2, wherein the distance between the through hole (48, 72) of the lever (16, 62) and an articulation point (34, 74) of the lever (16, 62) corresponds to approximately ⅓ of the length of the lever (16, 62).

14. Device according to claim 13, wherein a first straight line running between axis and articulation point (34, 74) and a second straight line running between the axis and the slot-shaped tube receptacle (26, 66) enclose an angle $\alpha$ within the range of $0° \leqq \alpha \leqq 90°$.

15. Device according to claim 14, wherein the angle $\alpha$ lies within the range of $45° \leqq \alpha \leqq 55°$.

16. Device according to claim 1, wherein the lever (16, 62) has a circumferential extension of $\beta$ within the range of $110° \leqq \beta \leqq 180°$.

17. Device according to claim 16, wherein the circumferential extension is $\beta = 145°$.

* * * * *